United States Patent [19]

Johannes

[11] 4,418,968

[45] Dec. 6, 1983

[54] FILING CABINET

[75] Inventor: Gerhardus A. J. Vrielink, Santpoort, Netherlands

[73] Assignee: Handelmaatschappij Twentex B.V., Haarlem, Netherlands

[21] Appl. No.: 219,898

[22] Filed: Dec. 24, 1980

[30] Foreign Application Priority Data

Dec. 28, 1979 [NL] Netherlands ..... 7909347

[51] Int. Cl.[3] ..... A47B 63/00; A47B 95/02; A42F 15/00

[52] U.S. Cl. ..... 312/184; 312/320

[58] Field of Search ..... 312/184, 186, 322, 323, 312/123, 133, 125, 135

[56] References Cited

U.S. PATENT DOCUMENTS

| | | | |
|---|---|---|---|
| 762,888 | 6/1904 | Decker | 312/123 |
| 1,217,973 | 3/1917 | Mann | 312/320 |
| 1,274,182 | 7/1918 | Miller | 312/133 |
| 1,416,661 | 5/1922 | Barnhart | 312/184 |
| 3,312,514 | 4/1967 | Barker | 312/184 |
| 3,312,515 | 4/1967 | Barker | 312/184 |
| 3,467,461 | 9/1969 | Hauser | 312/320 |
| 3,704,051 | 11/1972 | Kohler | 312/184 |

FOREIGN PATENT DOCUMENTS

| | | | |
|---|---|---|---|
| 286132 | 10/1952 | Switzerland | 312/184 |
| 866222 | 4/1961 | United Kingdom | 312/184 |
| 980919 | 1/1965 | United Kingdom . | |
| 2006115 | 5/1979 | United Kingdom . | |

*Primary Examiner*—Victor N. Sakran
*Attorney, Agent, or Firm*—Frost & Jacobs

[57] ABSTRACT

A cabinet consisting of a plurality of racks movable with respect to a frame, each rack having a plurality of support pins for suspendingly supporting flat, perforated articles to be filed in said cabinet; coupling means on each rack for releasably coupling said racks to each other and to said frame and arresting means for releasably arresting said rack or racks to said frame in an uncoupled, moved position of a rack or racks with respect to said frame; the improvement being that each rack is provided with a handle and control means such that said rack or racks can be uncoupled or the arrested position can be abolished by operating only one of said handles so that a person may use only one hand for said operation.

9 Claims, 14 Drawing Figures

FILING CABINET

The present application relates to a cabinet for suspendingly filing flat articles provided with perforations, the cabinet consisting of a plurality of racks, each pair of adjacent racks forming a compartment, said racks being provided with support pins which are mounted in displaced positions relative to each other and which extend over approximately the compartment depth, said racks being slidable in a frame relative to each other from a position for closing the compartments, via an intermediary position to a position in which an arbitrarily selected compartment is opened and reverse, in said positions the racks being adapted to be disconnectably coupled relative to the frame and with each other by means of coupling members and also being adapted to be arrested relative to the frame in the intermediary position or the opened position, said coupling being such that the racks, positioned in front of a compartment in the opening direction, are slidable as a coupled unit, and control means for selectively uncoupling at least one of the coupling members.

The present invention does substantially tend to achieve a construction in which uncoupling, abolishing the arresting of the racks as well as sliding the racks can be done with one hand only, so that the other hand of the operating person is free for other operations, like holding the articles to be filed in the cabinet. Moreover the invention tends to achieve a most simple and yet reliably working constructions, which is easy to repair and to service.

This object is achieved according to the invention because said control means consist of a handle with control members on each rack, said control members being such that said coupling members both for uncoupling the racks and abolishing the arresting of the racks can exclusively be controlled by only one of said handles at the time.

An embodiment according to the invention is preferably characterized in that for each rack said control members consist of two control bars which are adapted to be forced, by means of a spring, into openings in the supports of an adjacent rack and, for one of the racks, into openings in the frame, the control bars being adapted to be retracted from the openings by manipulating the handles on the respective rack.

In said embodiment the cabinet may be provided with at least one end cam by which one of the displaced racks, via its control bars and a hook, is adapted to be arrested relative to the frame, when the racks defining a selected compartment are in their opened position. Moreover in said embodiment the cabinet may be provided with at least one intermediary cam by which one of the displaced racks, via its control bars and a hook, is adapted to be arrested relative to the frame when the racks defining a selected compartment are in their opened position.

Moreover the invention provides a second main embodiment which is characterized in that for each rack the control members consist of a control shaft, pivotable by the handle and coupling pawls mounted on the control shaft, said pawls being pivotable for disconnecting them from coupling pins, said coupling pins being secured to the supports of an adjacent rack, and for one of the racks said coupling pins being secured to the frame.

In said embodiment one of the racks may be provided with an arresting cam which is adapted to releasably engage a terminal recess when the racks defining a selected compartment are in the opened position, an arresting bar being pivotable by means of the handle of the respective rack into a position for releasing the cam. Moreover in said second embodiment the cabinet may be provided with an intermediary recess engageable by the arresting cam when racks defining a selected compartment are at an intermediary position, an arresting bar being pivotable by means of the handle of the respective rack into a position for releasing the cam.

The invention will be further elucidated in the following description of the preferred embodiments which are illustrated in the drawing.

Figure 14:
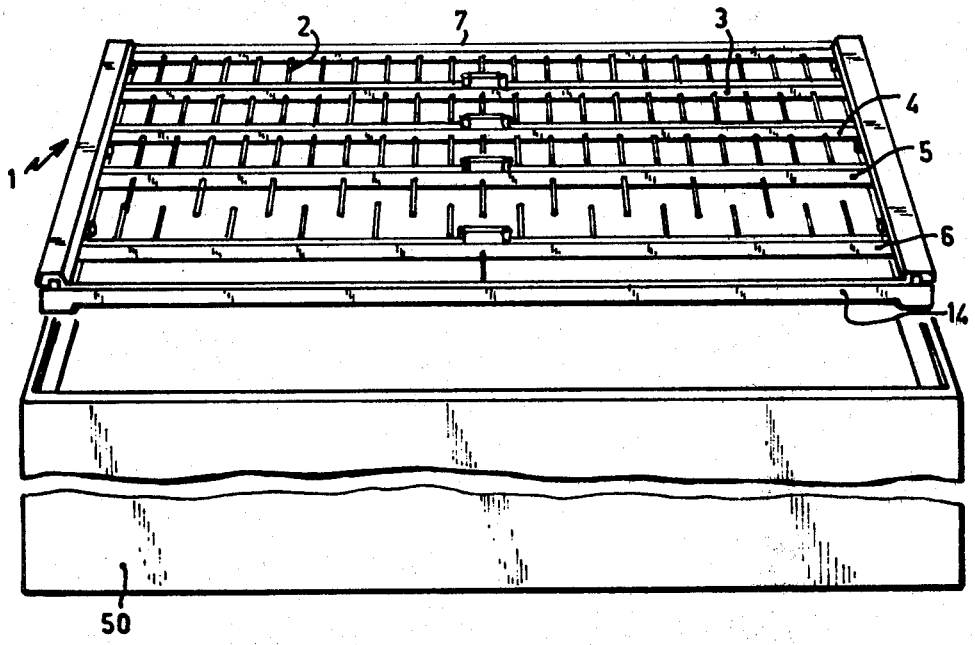
FIG. 14 is a perspective view of the suspension apparatus mounted in a cabinet.

Referring first to FIG. 14, a suspension apparatus 1 in accordance with the invention is adapted to be suspended within a conventional upwardly opening filing cabinet 50.

Figure 1:
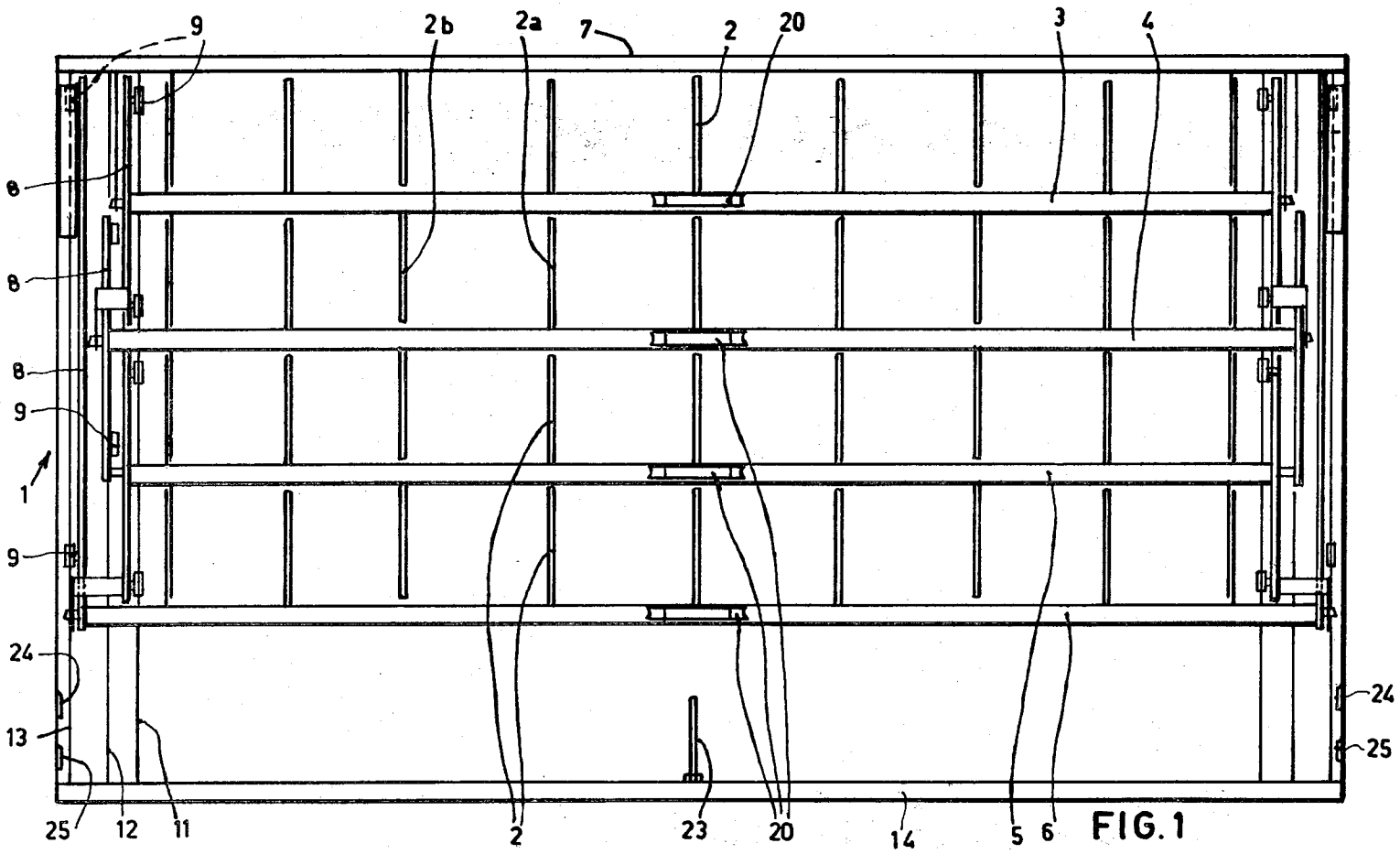
FIG. 1 is schematic plan view of an embodiment of the cabinet.
Figure 6:
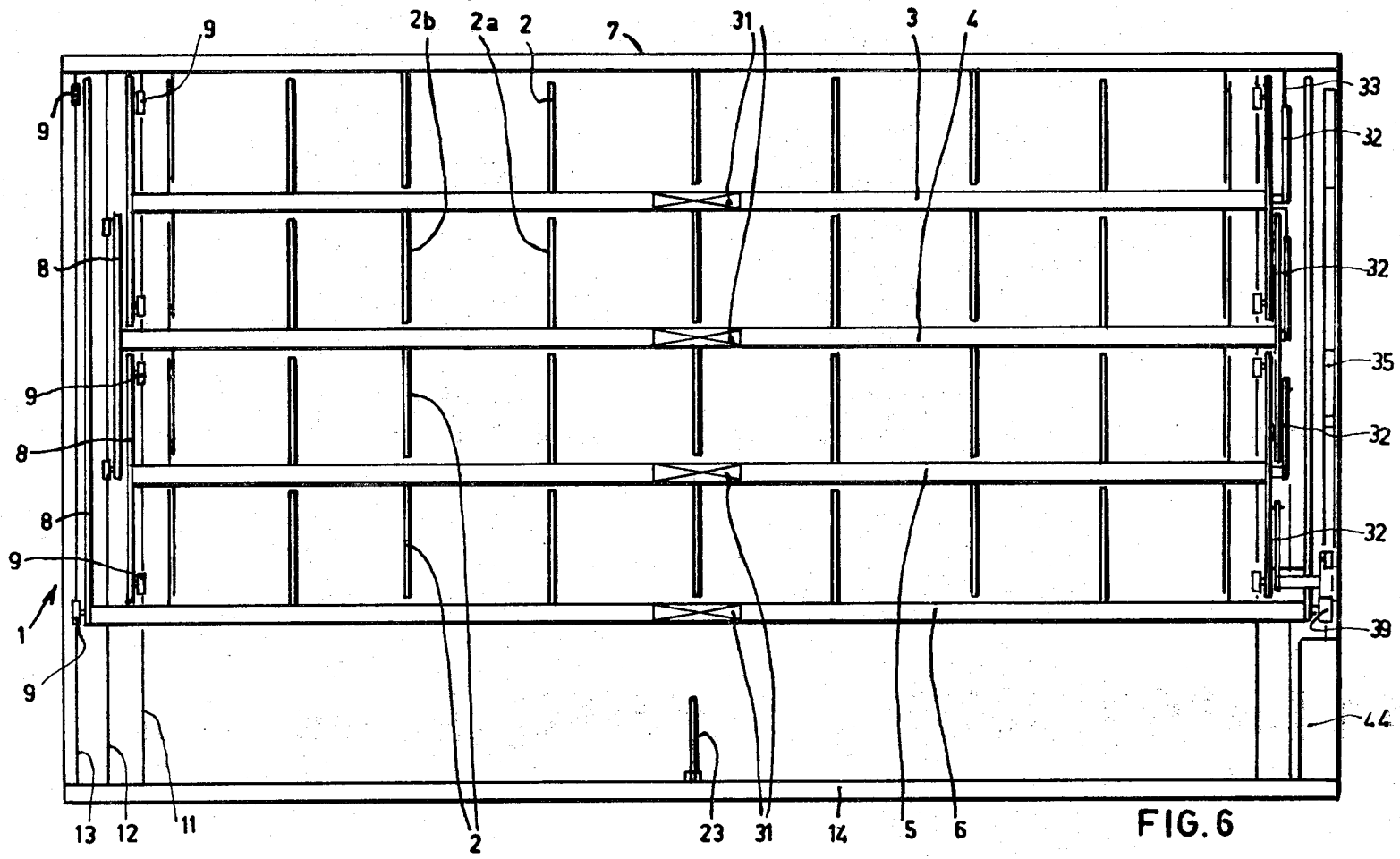
FIG. 6 is a schematic plan view of a second embodiment of the cabinet.
Figure 12:
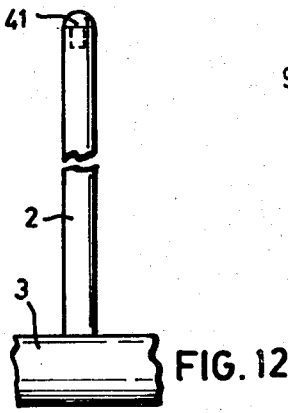
FIG. 12 is a side view of a support pin with a protective cap.

Both embodiments according to FIGS. 1 and 6 of the cabinet consist of a rigid frame 1 with four profiled beams in which four parallel racks 3, 4 5 and 6 are arranged movably relative to themselves, each rack being provided with support pins 2 positioned at mutually equal distances, the support pins 2*a* of the one rack 4 being arranged in displaced positions relative to the support pins 2*b* of the adjacent rack 3. It goes without saying that this applies for all support pins for all racks, the support pins of the one rack extending up to the vicinity of the adjacent rack so that in the closed position of the racks the articles, having perforations, may be suspended on the support pins 2*a* and 2*b* of two adjacent racks. The rear frame portion 7 is also provided with support pins 2 to form a compartment together with the rear rack 3, whereas the leading rack 6 is provided with support pins 2 at only one side, so that the leading rack and the next rack 5 form a leading compartment and moreover the leading racks is movable to the vicinity of the leading frame portion 14. At both ends, each rack is secured on supports 8 having rollers 9 with grooves bearing on rails 11, 12 and 13 which are secured to the left and right hand sides of the frame, Thereby the racks are each adapted to be rolled relative to each other in the direction of the leading frame portion 14 in order to open a selected compartment, i.e. two racks, defining the selected compartment, can be rolled away from each other so that then articles can be slid from or on the support pins of said racks. In FIGS. 1 and 6 the racks are illustrated in their closed position. It goes without saying that the dimensions of the frame and the number of racks can be determined at free choice. The support pins are preferably each provided with a protective cap 41 of synthetic material as according to FIG. 12 to protect the articles against damages.

Figures 2, 3, 4, 5, 13:
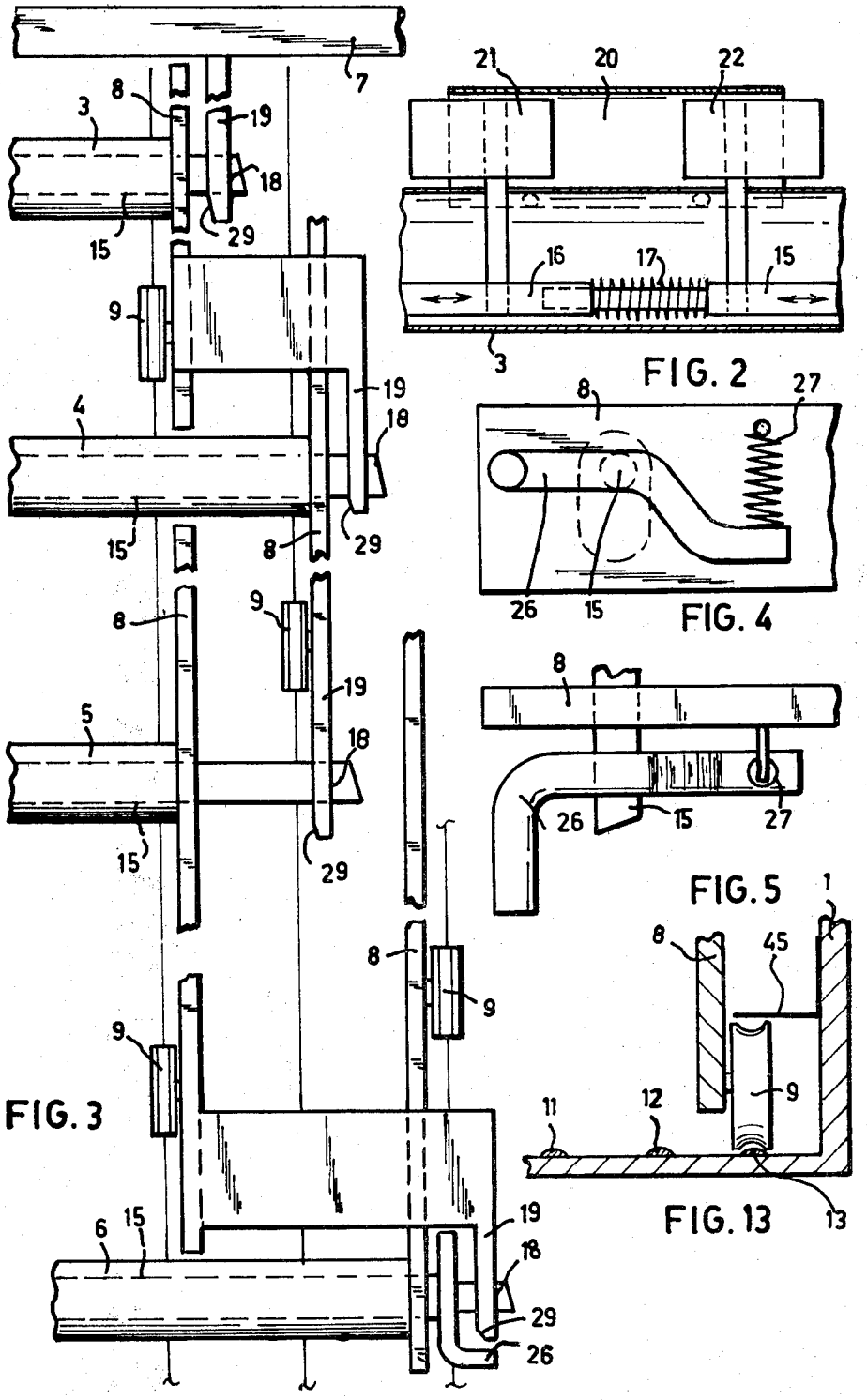
FIG. 2 is a front view of the handle for a rack belonging to the embodiment according to FIG. 1.
FIG. 3 shows at an enlarged scale the right-hand side of the mechanism according to FIG. 1.
FIG. 4 is a side view of the mechanism for arresting the leading rack in the cabinet according to FIG. 1.
FIG. 5 is a plan view of the mechanism according to FIG. 4.
FIG. 13 is a side view of the abutments for preventing the racks from being pulled out of their positions normal to the rails as well as their upward movement, said abutments belonging to the embodiment according to FIG. 1.

According to the embodiment of FIG. 1 two control bars 15 and 16 extend through each of the racks, said control bars being forced axially outwardly relative to each other by a spring 17 according to FIG. 2 so that the control bars of the one rack resiliently protrude into openings 18 in clips 19 which are secured to the supports 8 of an adjacent rack or in the event of the rear rack 3, are secured to the rear frame portion 7 as according to FIG. 3. Thus the racks are coupled to each other and to the frame and therefore, in the position according to FIG. 1, they are not displaceable.

At its centre, each rack is provided with a handle 20, whereas each control bar 15, 16 is connected to a button 21, 22 respectively, so that a person is able to seize the handle with one hand and to push the buttons towards each other with the same hand. By pressing the buttons 21 and 22 toward each other, the control bars 15 and 16 are forced toward each other against the force of the spring 17, so that the control bars are retracted from the respective openings 18, resulting in that the respective rack is then disconnected from the adjacent rack, or in the event of the rear rack 3, is then disconnected from the rear frame portion 7. Thus the disconnected rack and, if racks are present in front of the disconnected rack, racks coupled to the disconnected rack, are adapted to be moved forwardly to open the compartment defined by the disconnected rack. The racks which are possibly positioned at the rear side of the disconnected rack, remain coupled with the frame and thereby remain immovable.

In order to open for instance the compartment between the racks 4 and 5, the handle 20 of the rack 5 is operated, resulting in that the rack 5 is disconnected from the rack 4. The racks 3 and 4 remain coupled to the frame and the racks 5 and 6 remain mutually coupled but are displaceable in the frame toward the leading frame portion 14 by pulling the handle 20 of the rack 5.

In order to facilitate the operation of resiliently inserting the control bars 15 and 16 into the openings 18, the free ends of said control bars are beveled. Moreover according to FIG. 3 the free ends 29 of the clips 19 are provided with ramps so that in the event racks are moved toward each other in order to close a compartment, the control bars are automatically forced inwardly against the force of the spring 17 and are then forced into the openings 18 by the spring 17 so that the racks, defining said compartment, are coupled again.

Figure 11:
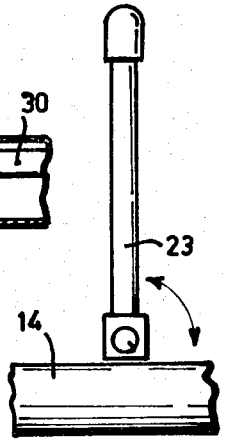
FIG. 11 is a plan view of the check pawl, which can be used both in the cabinet according to FIG. 1 and FIG. 6.

Preferably a check pawl 23 according to FIGS. 1 and 11 is provided, said check pawl protruding from the leading frame portion 14 up to such an extent that when a compartment is opened, the leading rack 6 strikes the check pawl the moment that an intermediary position is reached, i.e. the moment that the racks, defining the compartment to be opened, are moved away from each other over such a distance that the support pins 2 in said compartment just overlap each other. Because of this it is possible to slide the suspended articles over the support pins without risk that articles drop from the support pins. This sliding movement of the articles is required in order to select the article one is looking for among the suspended articles, said selected article being the article which one wishes to remove from the cabinet when the respective compartment is completely opened. Subsequently the check pawl 23 is pivoted up to against the leading frame portion 14, followed by the complete forward movement of the leading rack (with the racks possibly coupled therewith) in order to completely open the required compartment, i.e. to move the racks, defining said compartment to be opened, away from each other up to such a distance that the support pins 2 extending into said opened compartment, no longer overlap each other, so that an article can be taken from the support pins or can be suspended on the support pins.

In order to avoid that the racks move back in the closing direction in the event a compartment is opened in the intermediary position or the final position, the frame according to FIG. 1 is provided at both sides with an intermediary cam 24 and an end cam 25 behind which a hook 26 is adapted to engage. On each of the control bars 15 and 16 of the leading rack 6 a hook 26 is secured and a spring 27 pulls each hook to the horizontal position according to FIG. 4 because the other end of the spring is secured to the support 8 of the leading rack 6. When racks are moved toward the leading frame portion 14, the hooks 26 are forced upwardly by the rising rear sides of the cams 24 and 25 against the force of the spring 27 and after the hook passed each cam it is forced downwardly again by the spring so that the hook 26 engages behind the straight leading side of the cam 24 or 25 then, resulting in that then the leading rack 6 (and all racks possibly coupled therewith at that moment) is arrested with respect to the frame, i.e. cannot be moved rearwardly. In order to enable the racks to move rearwardly again, the handle 20 is pivoted relative to the tack 6, resulting in that the control bars 15 and 16 are pivoted such that the hooks 26 are pivoted upwardly and free from the cams 24 and 25 against the pulling force of the springs 27. During said pivotal movement the control bars 15 and 16 still protrude into the openings 18 in the clips 19 of the racks 5 so that the rack 6 can remain in the coupled condition with the rack 5. So in order to close an arbitrary compartment, always the handle 20 of the leading rack is pivoted rearwardly in order to displace the hooks 26 above over the cams 24 and 25 and said same handle is pushed rearwardly so that the leading rack 6 (and all racks, possibly coupled therewith) is moved rearwardly, during which the control bars 15 and 16 of the uncoupled rack rise against the ramps 29 of the rack located behind the uncoupled rack and finally these bars are resiliently inserted into the openings 18 of this successive rearwardly positioned rack by the force of the spring 17, so that all racks are coupled again as according to FIG. 1.

In order to avoid that, when the racks 3, 4, 5 and 6 are moved toward the leading frame portion 14, these racks will be pulled out their positions normal to the rails 11, 12, 12 respectively or can be moved upwardly resulting in that rollers 9 come free of the rails 11, 12 and 13, abutments 45 are secured to the side frame portion near the rear rollers 9 of the rack 6 as is indicated in FIG. 13. Said abutments 45, having a length which is equal to the distance between the intermediary and opened positions of a compartment, make sure that the rear rollers 9 of the leading rack 6 and thereby also of the trailing and coupled racks cannot be moved laterally or upwardly. The distance between the abutments 45 and the rollers 9 is chosen such that it is smaller than the depth of the grooves in the rollers 9.

A second embodiment of the cabinet is illustrated in FIGS. 6 through 10 and with respect to the racks 3, 4, 5 and 6 the support pins 2, the frame 1, the supports 8, the rollers 9, the rails 11, 12 and 13 and the check pawl 23 it is similar to the embodiment according to FIG. 1 so that for these items reference is made to the above description to FIG. 1. In the embodiment according to FIGS. 6 through 10 only the coupling mechanism and the arresting mechanism are constructed in a different way.

Figure 8:
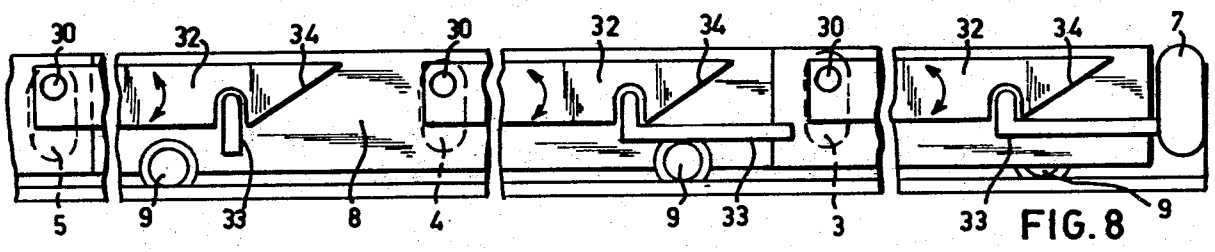
FIG. 8 is a side view at a larger scale of the right-hand side of the mechanism according to FIG. 6, except for the mechanism belonging to the leading rack.
Figure 10:
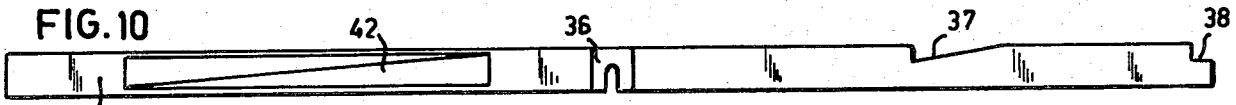
FIG. 10 is a side view of the arresting bar as it is used in the embodiment according to FIG. 6.
Figure 7:
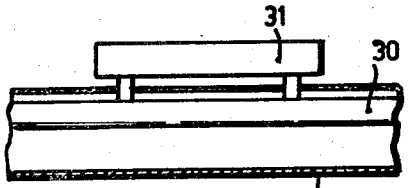
FIG. 7 is a front view of the handle for a rack, belonging to the embodiment according to FIG. 6.

According to FIGS. 6 and 7 a control shaft 30 extends through each rack, said shaft being pivotable by a handle 31 and provided at both ends with coupling pawls 32 adapted to engage pins 33 according to FIG. 8. The pins are secured to the supports 8 of adjacent racks or in the event of the rear rack 3 the pins 33 are secured to the rear frame portion 7. Only in the leading rack the coupling pawls are not secured to the control shaft 30, but to the supports 8 of the rack 5 as according to FIG. 9, and a lever 43 is secured to the control shaft 30 of the leading rack 6, so that by pivoting said lever 43 upwardly by means of the handle 31 of the leading rack 6, the coupling pawls 32 for the leading rack are pivoted away from the pins 33 on the supports 8 of the leading rack, resulting in that then the leading rack 6 is disconnected from the next rack 5. The racks 5 and 4 can be disconnected from each other and from the rack 13 by pivoting the coupling pawls 32 from their pertaining pins 33 by means of their pertaining handles 31 and the rack 3 can be disconnected from the rear frame portion 7 by pivoting its pertaining coupling pawls 32 from the pins 33 secured to said frame portion. Thus all racks are coupled with each other and with the frame, and thereby they are not free to move from their positions according to FIG. 6.

By pivoting the handle 31 arranged at the center of each rack, a person is able by means of only one hand to disconnect each rack from the adjacent rack or, in the event of the rear rack 3, to disconnect it from the frame. In this way the disconnected rack (with racks, possibly positioned in front thereof and coupled thereto) can be moved forwardly in order to open the compartment defined by the disconnected rack. In the event that racks are located behind the disconnected rack, these rearwardly positioned racks remain coupled with the frame and thus remain immovable.

According to FIG. 8 all coupling pawls 32 are provided with ramps 34 so that when pushing racks toward each other in order to close a compartment, the respective coupling pawls rise against the pertaining pins 33 and then pivot downwardly under the influence of their own weight to engage the pins, so that the coupled condition is achieved again.

If a compartment is opened in the intermediary position of the terminal position, movement of the racks back in the direction of closing the compartment is avoided because the frame is provided with an arresting bar 35 which is pivotable in a vertical plane by suspending it at its center 36 on the sides of the frame. At its rear end the arresting bar is provided with a weight 42 so that the position of the bar is upwardly inclined in the direction of its leading end. The leading end of the arresting bar is provided with an intermediary recess 37 and an end recess 38. According to FIG. 9 the lever 43 is provided with arresting cam 39 and a wheel 40, and normally the cam exerts a downwardly force on the bar so that when the racks move forwardly, the cam arrives first in the intermediary recess 37 thereby allowing the arresting bar to pivot upwardly, resulting in that the displaced racks are arrested in their intermediary position and if the racks are furthermore moved forwardly, the cam arrives in the end recess 38 thereby allowing the arresting bar to pivot upwardly, resulting in that the displaced racks are arrested in their terminal position.

In order to be able to move the racks rearwardly, the handle 31 is pivoted rearwardly relative to the leading racks 6, resulting in that the lever 43 and the wheel 40 are pivoted downwardly so that the wheel exerts force on the arresting bar 35, having as a consequence that the leading end of the arresting bar pivots downwardly down to such an extent that the arresting cam 39 is released from the intermediary recess 37 or the end recess 38 and in the event of being moved back from the end recess 38, the cam can no longer engage into the intermediary recess 37 so that the racks can be moved back to the compartment closing position. So, in order to close an arbitary compartment, the handle 31 on the leading rack 6 is always moved rearwardly in order to keep the arresting cam 39 free from the arresting bar 35, and this same handle is pushed rearwardly so that the leading rack and all racks which are possibly coupled therewith, are pushed rearwardly, during which the coupling pawls 32 of the disconnected rack may rise against the pins 33 on the rack located therebehind, and then, because of their weight, said coupling pawls drop over said pins so that all racks are coupled again, as according to FIG. 6.

Figure 9:
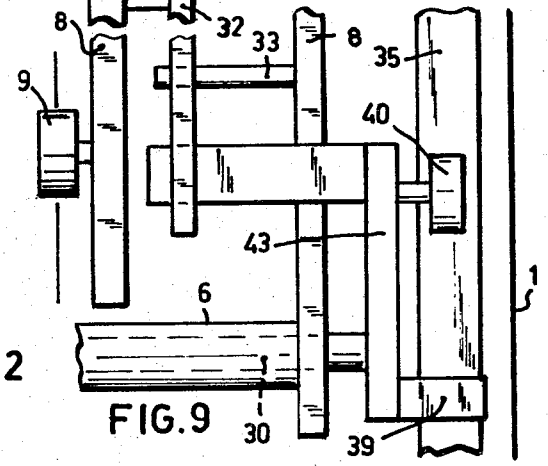
FIG. 9 is a plan view at a larger scale of the right-hand side of the mechanism according to FIG. 6 for the leading rack.

In this respect it is remarked that in order to disconnect the leading rack 6 relative to the successive rack 5, the handle 31 of the leading rack is pivoted forwardly, so that the lever 43 with the wheel 40 is pivoted upwardly in order to disconnect the coupling pawl 32 from the pin 33 according to FIG. 9, whereas in order to release the cam 39 from one of the recesses 37 or 38 in the arresting bar 35 the lever 43 is pivoted in the opposite direction, thus downwardly so that the leading rack 6 remains coupled with the next rack 5 then.

A covering post 44 makes sure that the lever 43 cannot be pivoted upwardly until all racks are in the closed position, resulting in that the covering post 44 makes sure that the leading rack 6 can only be disconnected from the preceding rack 5 if all racks are in their closed position so that in the arrested position of the leading rack 6, its coupled position with possibly successive racks cannot be abolished.

The two embodiments as indicated above have as an evident advantage that a person is able to operate the racks with only one hand both for opening and closing them, i.e. opening up to the intermediary position, opening it further to the completely open position, abolishing the arrested situation in the open position and closing can be done with one hand, and moreover the mechanism is most simple, cheap and reliable.

What is claimed is:

1. In apparatus for the suspension filing of sheet articles having peforations extending along their upper edges, a support frame having front and rear portions interconnected at their opposite ends by guide rails, a plurality of racks extending between and movably mounted on said guide rails, suspension carrier pins mounted on said racks positioned to engage the perforations in the articles to be filed, said carrier pins being oppositely directed and in staggered relationship to each other, adjacent racks being movable relative to each other from a closed position in which the said adjacent racks define a suspension compartment therebetween with their respective carrier pins extending across the suspension compartment to an intermediate position in which the carrier pins just overlap each other, and to an open position in which the carrier pins are spaced apart to permit removal of articles suspended on the pins, an actuating rod extending along the length of each rack, means mounting each of said actuating rods for movement in a plurality of directions, an operating handle connected to each actuating rod for moving said rod, and coupling means carried by each rack to detachably connect it to the next rearward rack, said coupling means being operatively connected to said actuating rods, whereby movement of said actuating rods in a first direction will actuate said coupling means to disengage a selected rack from the next adjacent rack, the improvement which comprises locking means carried by the frontmost rack for selectively locking the frontmost rack and any additional racks coupled thereto in either the open or intermediate positions, said locking means comprises at least one end cam mounted on said frame, a hook mounted on the actuating rod of said frontmost rack positioned to releasably engage said cam to lock said foremost rack in the open position, said hook being displaceable to release said foremost rack for rearward movement upon movement of said rod in a second direction.

2. The apparatus claimed in claim 1 including spring means acting to bias said hook toward said end cam, said end cam being configured to displace said hook against the pressure of said spring means to permit the hook to pass the end cam when said frontmost rack is being moved forwardly.

3. The apparatus claimed in claim 2 wherein said locking means includes a second end cam positioned to releasably engage said hook when said frontmost rack is in the intermediate position, movement of the rod in said second direction acting to release the hook from said intermediate cam.

4. The apparatus claimed in claim 3 wherein said intermediate cam is configured to displace said hook against the pressure of said spring means to permit said hook to pass the intermediate cam when said frontmost rack is being moved forwardly.

5. In apparatus for the suspension filing of sheet articles having perforations extending along their upper edges, a support frame having front and rear portions interconnected at their opposite ends by guide rails, a plurality of racks extending between and movably mounted on said guide rails, suspension carrier pins mounted on said racks positioned to engage the perforations in the articles to be filed, said carrier pins being oppositely directed and in staggered relationship to each other, adjacent racks being movable relative to each other from a closed position in which the said adjacent racks define a suspension compartment therebetween with their respective carrier pins extending across the suspension compartment to an intermediate position in which the carrier pins just overlap each other, and to an open position in which the carrier pins are spaced apart to permit removal of articles suspended on the pins, an actuating rod extending along the length of each rack, means mounting each of said actuating rods for movement in a plurality of directions, an operating handle connected to each actuating rod for moving said rod, and coupling means carried by each rack to detachably connect it to the next rearward rack, said coupling means being operatively connected to said actuating rods, whereby movement of said actuating rods in a first direction will actuate said coupling means to disengage a selected rack from the next adjacent rack, the improvement which comprises locking means carried by the frontmost rack for selectively locking the frontmost rack and any additional racks coupled thereto in either the open or intermediate positions, said locking means comprises a locking cam operatively connected to the actuating rod of said frontmost rack, and a arresting means mounted on said frame in a position to be engaged by said locking cam, said locking cam being disengagable from said arresting means upon movement of said actuating rod in a second direction.

6. The apparatus claimed in claim 5 wherein said arresting means has at least one recess therein engagable by said locking cam upon movement of said frontmost rack to the open position, said locking cam being removable from said recess upon movement of the actuating rod of said frontmost recess in said second direction.

7. The apparatus claimed in claim 6 wherein said arresting means includes a second recess positioned to be engaged by said locking cam when said frontmost rack is in the intermediate position.

8. The apparatus claimed in claim 7 wherein said arresting means comprises an elongated locking bar pivotally mounted on said frame, said locking bar having recesses therein defining the intermediate and open positions of said frontmost rack, movement of the actuating rod of said frontmost rack in said second direction acting to pivot said locking bar to a position in which said locking cam will be released from the recess in which it is engaged.

9. The apparatus claimed in claim 1 or 5 including a check pawl mounted on the front portion of said frame, said check pawl having a length such that, when a rack defining a selected compartment is in the intermediate position, the frontmost rack strikes said check pawl, said pawl being adapted to be pivoted relative to the front portion of said frame so as to permit the frontmost rack to move to the open position.

* * * * *